US006597339B1

(12) United States Patent
Ogawa

(10) Patent No.: US 6,597,339 B1
(45) Date of Patent: Jul. 22, 2003

(54) INFORMATION PROCESSING APPARATUS

(75) Inventor: Kiyohisa Ogawa, Ome (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 103 days.

(21) Appl. No.: 09/661,917

(22) Filed: Sep. 14, 2000

(30) Foreign Application Priority Data

Nov. 30, 1999 (JP) ..... 11-341048

(51) Int. Cl.[7] ..... G09G 3/36
(52) U.S. Cl. ..... 345/102; 349/61
(58) Field of Search ..... 345/102, 87; 362/31; 349/61, 62, 68, 69, 70

(56) References Cited

U.S. PATENT DOCUMENTS

| | | | | |
|---|---|---|---|---|
| 5,065,357 A | * | 11/1991 | Shiraishi et al. | 345/102 |
| 5,315,695 A | * | 5/1994 | Saito et al. | 345/102 |
| 5,493,685 A | | 2/1996 | Zenda | |
| 5,839,812 A | * | 11/1998 | Ge et al. | 362/31 |
| 5,970,419 A | | 10/1999 | Terashima et al. | |
| 6,111,559 A | * | 8/2000 | Motomura et al. | 345/102 |
| 6,219,021 B1 | * | 4/2001 | Izumi | 345/102 |
| 6,268,844 B1 | * | 7/2001 | Jun | 345/102 |
| 6,404,145 B1 | * | 6/2002 | Saito | 315/307 |

FOREIGN PATENT DOCUMENTS

| | | |
|---|---|---|
| EP | 0 730 371 A2 | 9/1996 |
| EP | 0 730 371 A3 | 9/1998 |
| GB | 2 322 219 | 8/1998 |
| JP | 4-184484 | 7/1992 |
| JP | 11-126118 | 5/1999 |
| WO | WO 99/26389 | 5/1999 |

* cited by examiner

*Primary Examiner*—Dennis-Doon Chow
(74) *Attorney, Agent, or Firm*—Pillsbury Winthrop LLP

(57) ABSTRACT

In an information processing apparatus, the power consumption can be reduced by controlling the luminance of a backlight, without degrading operability of the apparatus. In the information processing apparatus having an LCD with a backlight, a CPU alters the luminance of the backlight in accordance with a content of a process (application program) to be executed, or a display content of information on the LCD. Where it is not necessary that the display content on the LCD be presented to the user in such a way that the display content may easily and clearly viewed by the user, the luminance of the backlight is decreased to save power consumption.

7 Claims, 4 Drawing Sheets

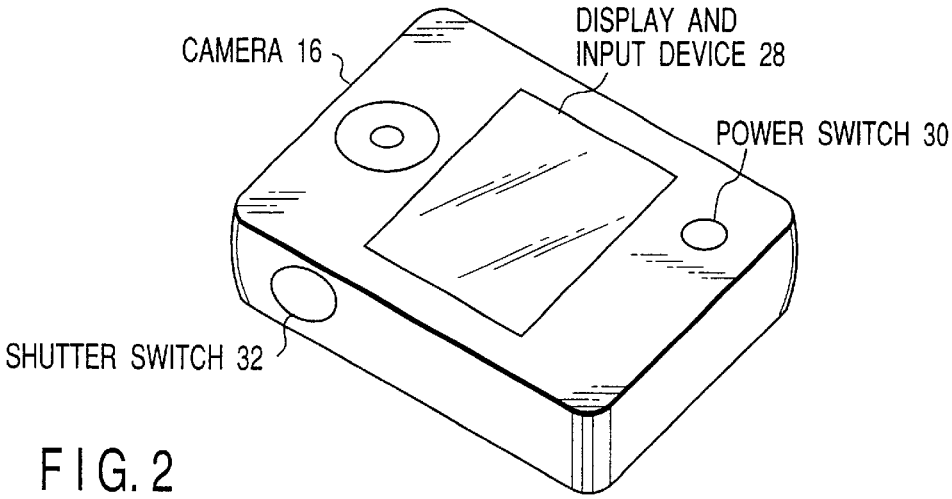
FIG. 2
BACKLIGHT LUMINANCE DATA
| | |
|---|---|
| LEVEL 1 | (100%) |
| LEVEL 2 | ( 70%) |
| LEVEL 3 | ( 60%) |
| LEVEL 4 | ( 50%) |
| LEVEL 5 | ( 30%) |
FIG. 3
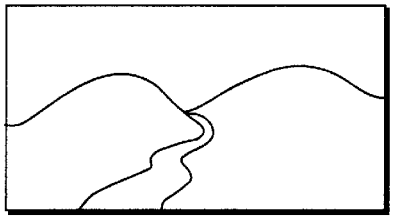
FIG. 5A CAMERA IMAGE DISPLAY SCREEN
(BACKLIGHT LEVEL 1 (100%))
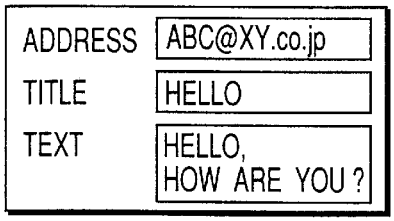
MAIL MANAGEMENT DISPLAY SCREEN
(BACKLIGHT LEVEL 3 (60%))
FIG. 5B
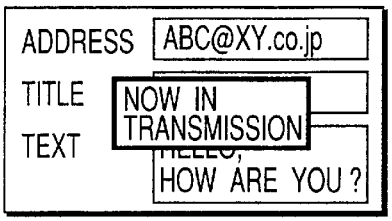
SCREEN INDICATING "NOW IN TRANSMISSION"
(BACKLIGHT LEVEL 5 (30%))
FIG. 5C

INFORMATION PROCESSING APPARATUS

CROSS-REFERENCE TO RELATED APPLICATIONS

This application is based upon and claims the benefit of priority from the prior Japanese Patent Application No. 11-341048, filed Nov. 30, 1999, the entire contents of which are incorporated herein by reference.

BACKGROUND OF THE INVENTION

The present invention relates to an information processing apparatus such as a small-sized portable terminal, which has a display device with a backlight.

In recent years, information processing apparatuses have been developed, which are provided with cameras and are capable of acquiring a color image, storing it as a file, or sending it along with an e-mail. In particular, if this type of information processing apparatus is constructed as a battery-powered portable device, the information processing apparatus can be carried to a desired place and a color image can be acquired there.

A color image acquired by the camera has a lower contrast than a computer-graphics (CG) image. Thus, the color image acquired by the camera becomes easier to view, if it is displayed on a backlight-equipped display device with a backlight luminance increased. However, if the backlight luminance is increased, the power consumption increases. In the case of a battery-powered information processing apparatus, lower power consumption is required in order to increase a time period in which stable operations are ensured. In addition, a luminance control for a backlight that consumes relatively high power is also required. In particular, in the case of a small-sized information processing apparatus, the problem of power consumption is serious since it cannot be equipped with a high-capacity battery.

Moreover, in the case of a battery-powered information processing apparatus including a display device with a backlight, the ratio of power consumption of the backlight to the total power consumption of the apparatus is high. When the remaining power of the battery has decreased, the power consumption of the backlight affects the stability in operation of the apparatus.

BRIEF SUMMARY OF THE INVENTION

An object of the present invention is to provide an information processing apparatus, the power consumption of which can be reduced by controlling the luminance of a backlight, without degrading operability of the apparatus.

Another object of the invention is to provide a battery-powered information processing apparatus having a display device with a backlight, which can be stably operated even where the remaining power of the battery has decreased.

According to an aspect of the present invention, there is provided an information processing apparatus. The apparatus comprises a display device for displaying information; backlight means for emitting a backlight to the display device, the backlight having various luminance levels; discrimination means for discriminating a display content of information displayed on the display device; and screen control means for altering a luminance of the backlight in accordance with the display content discriminated by the discrimination means.

With this structure, the luminance of the backlight can be altered in accordance with the display content on the display device. Where it is not necessary that the display content on the display device be presented to the user in such a way that the display content may easily and clearly viewed by the user, the luminance of the backlight may be decreased to save power consumption.

It is preferable that the screen control means increases the luminance of the backlight where the discrimination means has determined that an image is to be displayed on the display device.

The feature of the camera image is the presence of medium colors on a most part of the image, with a neutral-level (not high) chroma and brightness. Accordingly, the luminance of the backlight is increased to make the camera image easier to view.

It is preferable that the information processing apparatus further comprises transmission/reception means for transmitting/receiving an e-mail. The screen control means decreases the luminance of the backlight where the discrimination means has determined that a screen image indicative of a state in which the e-mail is being transmitted is to be displayed on the display device.

While the e-mail is being transmitted, display is made only to show a progress of the operation to the user, and the user is not permitted to perform any operation with reference to the display screen. Accordingly, only if a display of the operation state can be visually recognized on the display device, some difficulty in viewing the display content will pose no problem. Thus, the luminance of the backlight is decreased.

The information processing apparatus may further comprise first determination means for determining whether a predetermined time period has passed since latest input of data by means of input means. When the first determination means has determined that the predetermined time period has passed, the screen control means may decrease the luminance of the backlight.

The information processing apparatus may further comprise second determination means for determining whether a predetermined time period has passed since a latest operation of camera operation means. When the second determination means has determined that the predetermined time period has passed, the screen control means may decreases the luminance of the backlight.

Where no data has been input or the operation section has not been activated for a predetermined time period, it is probable that the user is not currently viewing the display device and in this case power is wasted if the luminance of the backlight is maintained at high level. Accordingly, if a predetermined time has passed, the luminance of the backlight may be lowered to save power consumption.

The information processing apparatus may be driven by a battery and further comprise monitor means for monitoring a state of the battery. It is preferable that the monitor means monitors a remaining power of the battery and the screen control means decreases the luminance of the backlight when the monitored remaining power of the battery has decreased to a predetermined value or less.

In some cases, when the remaining power of the battery has decreased, an increase in operation time of the information processing apparatus is preferable at the cost of ease in viewing the screen. In such cases, the operation time of the information processing apparatus is increased by lowering the luminance of the backlight.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 2 shows an external structure of the information processing apparatus according to the embodiment of the invention;

FIG. 3 shows an example of backlight luminance data 122 in the embodiment;

FIG. 4 is a flow chart illustrating an operation after the information processing apparatus is switched on;

FIGS. 5A to 5C show examples of display contents on a camera image display screen, a mail management display screen and a mail sending screen.

DETAILED DESCRIPTION OF THE INVENTION

An embodiment of the present invention will now be described with reference to the accompanying drawings.

Figure 1:
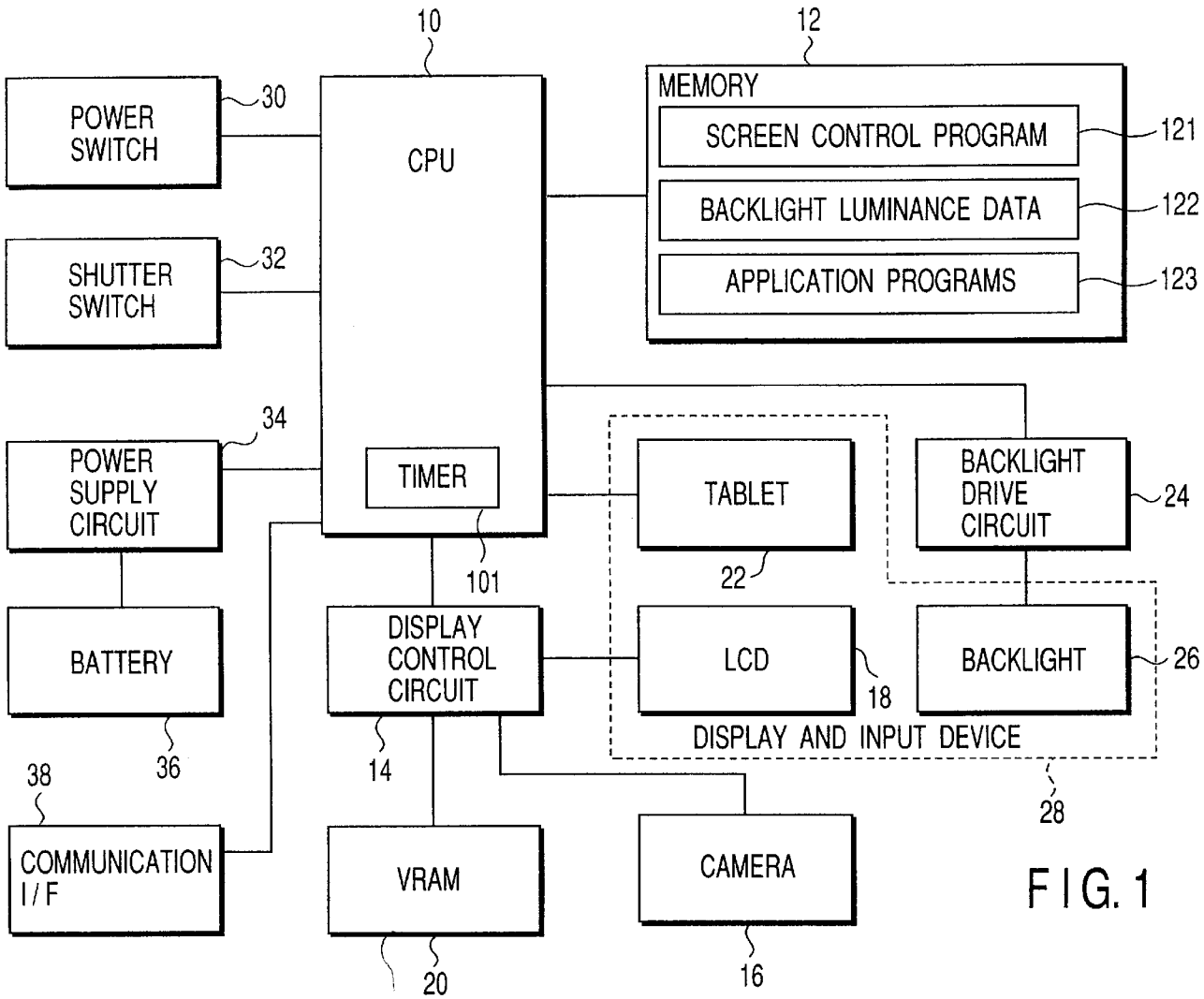
FIG. 1 is a block diagram showing a system structure of an information processing apparatus according to an embodiment of the present invention.

FIG. 1 is a block diagram showing a system structure of an information processing apparatus according to the embodiment of the invention. The functions of the information processing apparatus of this embodiment are realized by a computer. The computer reads in a program recorded on a recording medium, and the operation of the computer is controlled by this program. In addition, the information processing apparatus of this embodiment is a small-sized portable terminal driven by a battery. When the portable terminal is connected to a radio communication apparatus such as a mobile phone or a personal handyphone system (PHS), information such as an image acquired at a given location may be sent out.

As is shown in FIG. 1, the information processing apparatus of this embodiment comprises a CPU 10, a memory 12, a display control circuit 14, a camera 16, an LCD (liquid crystal display) 18, a VRAM 20, a tablet 22, a backlight drive circuit 24, a backlight 26, a power switch 30, a shutter switch 32, a power supply circuit 34, a battery 36, and a communication interface (I/F) 38.

The CPU 10 controls the entirety of the apparatus, and it executes programs stored in the memory 12, thereby to realize various functions. Specifically, the CPU 10 executes a screen control program 121, thereby to discriminate a display content displayed on the LCD 18. In accordance with the display content, a screen control is performed to adjust the luminance of the backlight 26. In addition, the CPU 10 can monitor a lapse of time from the latest input of data and a lapse of time from the latest operation of an operation section of the camera 16, by referring to the timer 101.

The memory 12 stores programs to be executed by the CPU 10 and various data. The memory 12 stores, for instance, the aforementioned screen control program 121, and backlight luminance data 122 used for screen control. The backlight luminance data 122 is data for enabling the backlight drive circuit 24 to control the luminance of the backlight 26. In addition, the memory 12 stores various application programs 123 for executing various processes. The application programs 123 include those for acquiring images by means of the camera 16 and for transmitting/receiving e-mails.

The display control circuit 14 performs, under control of the CPU 10, a control for displaying an image on the LCD 18 and a control for acquiring an image from the camera 16. The display control circuit 14 writes image data to be displayed on the LCD 18 into the VRAM 20, and effects, for example, color display on the LCD 18 in accordance with the image data. In a camera operation mode in which a color image is acquired from the camera 16, the display control circuit 14 displays the color image acquired by the camera 16 on the LCD 18.

The camera 16 is activated by an activation instruction from the CPU 10 and then acquires the color image. In the camera operation mode in which the camera 16 is activated, the color image acquired by the camera 16 is displayed on the LCD 18. The LCD 18 performs image display under control of the display control circuit 14 and, for example, it performs display of a color image. The VRAM 20 stores image data of an image to be displayed on the LCD 18.

A tablet 22 is used for inputting coordinates data in order to input an operation instruction or an image pattern to the apparatus. For example, a pressure-sensitive type tablet is used. The tablet 22 is formed to be transparent so as to pass light. The tablet 22 is stacked on the display screen of the LCD 18 as one body. Accordingly, while viewing the display content (various objects such as menus) displayed on the LCD 18, coordinates data corresponding to a location of display content can be directly input.

The backlight drive circuit 24 functions to drive the backlight 26 to emit light. The backlight drive circuit 24 can vary the luminance level of the backlight 26 in accordance with an instruction on the luminance level from the CPU 10.

The backlight 26 is a light source provided on a back side of the LCD 18, and it is driven by the backlight drive circuit 24. The LCD 18 and tablet 22 which are integrally stacked on one another and backlight 26 constitute a display and input device 28.

The power switch 30 is a switch operated to instruct activation/halt of the apparatus. The shutter switch 32 is a switch operated to instruct a shift to a camera operation mode for activating the camera, or to instruct acquisition of a still image in the camera operation mode. The power supply circuit 34 supplies power from the battery 36 to the respective structural components of the apparatus and monitors the state of the battery 36 (e.g. the remaining power of the battery). The battery 36 supplies power to activate the apparatus.

The communication interface 38 is an interface for connection with a radio communication apparatus such as a mobile phone or a PHS. The communication interface 38 is used to wirelessly send out various information such as images acquired by the camera 16.

FIG. 2 shows an external structure of the information processing apparatus according to the embodiment of the invention.

As is shown in FIG. 2, the information processing apparatus of this embodiment is formed to have a small, portable size so that the casing thereof may be placed, for example, on the palm. The camera 16 is disposed near one end portion of an upper surface of the casing. The display and input device 28 (LCD 18, tablet 22 and backlight 26) is disposed near a central portion of the upper surface of the casing. The power switch 30 is provided near another end portion opposed to the camera 16. In addition, the shutter switch 32 is disposed on a side surface of the casing at such a position as to facilitate the operation by the forefinger when the apparatus is held by the right hand with its lower surface put on the palm and the camera 16 facing upward.

The backlight luminance data 122 stored in advance in the memory 112 will now be described.

As is shown in FIG. 3, a plurality of adjustable luminance levels (LEVEL 1, LEVEL 2, LEVEL 3, LEVEL 4, and LEVEL 5) which can be chosen by the backlight drive circuit 24 are registered in the backlight luminance data 122. In the example shown in FIG. 3, level 1 indicates 100%, or a highest luminance. Level 2 indicates 70%, level 3 indicates 60%, level 4 indicates 50%, and level 5 indicates 30%. Since FIG. 3 shows only the example, other luminance levels may be registered. The CPU 10 notifies the backlight drive circuit 24 of a predetermined level, thereby altering the luminance of the backlight 26. The respective luminance levels may be stored in the memory 12 in association with images displayed on the LCD 18.

Figure 4:
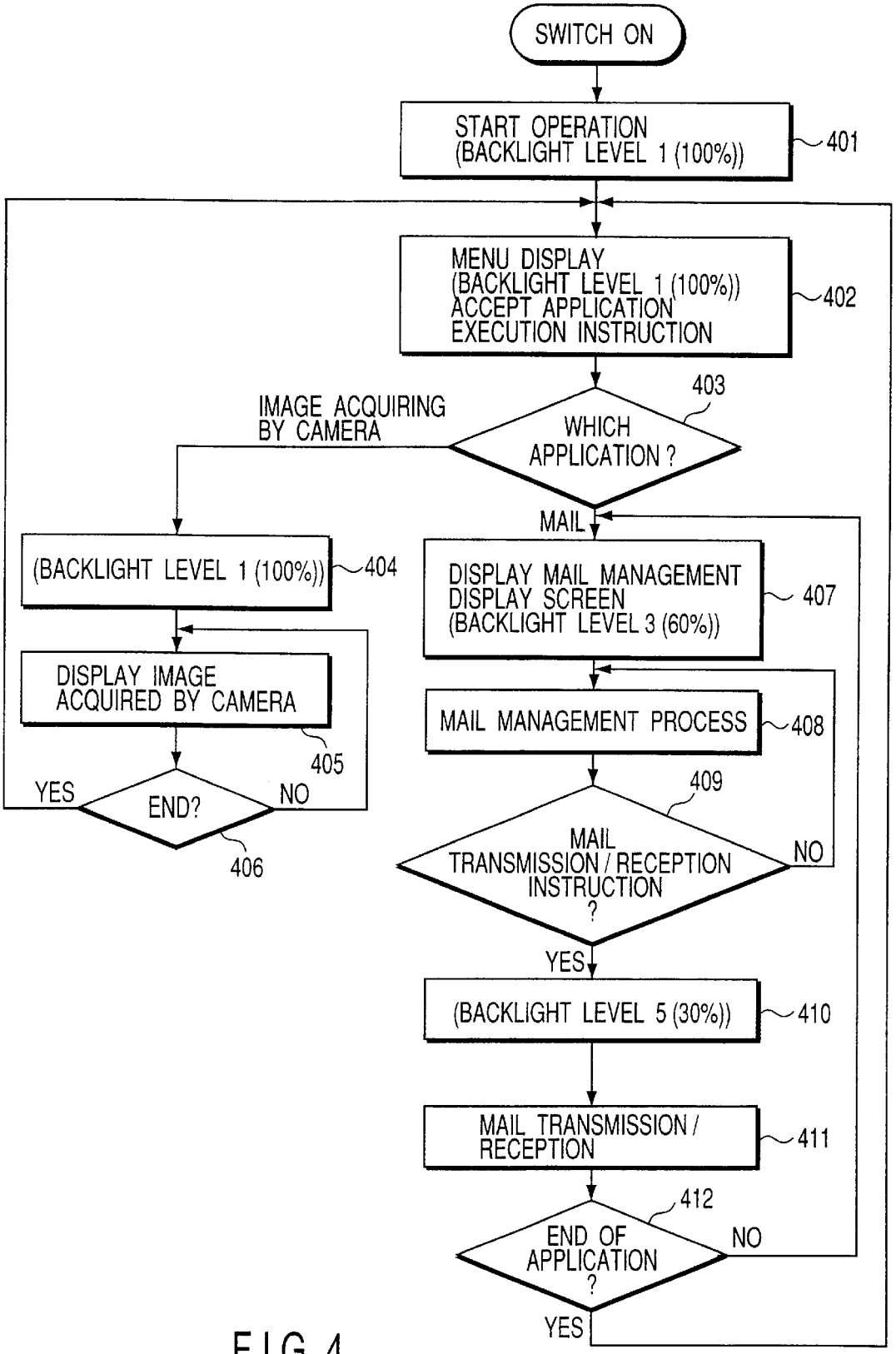

The operation of the present embodiment will now be described with reference to a flow chart. FIG. 4 is a flow chart for describing the operation of the information processing apparatus, following the switching-on of the apparatus.

To start with, the power switch 30 is depressed to instruct activation of the information processing apparatus (step 401). The CPU 10 activates the respective parts of the apparatus and causes the LCD 18 to display a screen for notifying the user that the apparatus has been activated. In addition, the CPU 10 instructs the backlight drive circuit 24 to set the luminance of the backlight 26 at level 1 (100%) (step 401).

When the CPU 10 has completed the process for activating the apparatus, it then causes the LCD 18 to display a menu for enabling the user to designate available functions (step 402). The luminance of the backlight 26 at this time is also set at level 1 (100%).

The menu shows, for instance, icons indicating available functions (various application programs). For example, execution of image acquisition by the camera 16 or e-mail transmission/reception can be designated. The selection of the function from the menu is effected by pointing the location of the icon or the like displayed on the LCD 18 by means of a pen or the like. Thereby, coordinates data of the pointed location is input through the tablet 22 and the selected function is discriminated.

Where the execution of image acquisition by the camera 16 is designated (step 403), the CPU 10 activates the camera 16 and initiates the camera operation mode. Then, in order to clearly display the image acquired by the camera 16 on the LCD 18, the CPU 10 instructs the backlight drive circuit 24 to set the luminance of the backlight 26 at level 1 (100%) (step 404).

In general, an image acquired by the camera 16 is an image of a landscape, as shown in FIG. 5A, or an image of a person. The feature of such images is the presence of medium colors on a most part of the image, with a neutral-level (not high) chroma and brightness. Accordingly, in the camera display mode in which the camera image is displayed on the LCD 18, the luminance of the backlight 26 is increased to make the camera image easier to view.

The image acquired by the camera 16 is displayed on the LCD 18 by the display control circuit 14 (step 405). The image displayed on the LCD 18 is easy to view, since the luminance of the backlight 26 is set at level 1 (100%).

On the other hand, where execution of e-mail transmission/reception has been selected from the menu (step 403), the CPU 10 causes the LCD 18 to display a mail management display screen and instructs the backlight drive circuit 24 to set the luminance of the backlight 26 at level 3 (60%) (step 407).

The main management display screen, as shown in FIG. 5B, is a screen displaying text (character) data in the main, such as "address", "title" and "e-mail text". Accordingly, the display content can be clearly recognized even if the luminance of the backlight 26 is not so much increased as in the case of displaying the camera image acquired by the camera 16.

While the mail management display screen is being displayed, the mail management process is executed, and a display content such as "address", "title" and "e-mail text" is input on the basis of data input through the tablet 22 (step 408). If the execution of the mail transmission/reception is designated after the data necessary for the mail management process is input (step 409), the CPU 10 instructs the backlight drive circuit 24 to set the luminance of the backlight 26 at level 5 (30%) (step 410). Subsequently, the CPU 10 is connected to the network via a radio communication apparatus such as a mobile phone or a personal handyphone system (PHS), to which the information processing apparatus is connected via the communication interface 38. Thus, the CPU 10 sends an e-mail prepared on the mail management display screen to a server of an Internet service provider (ISP) and also sends a reception request for an e-mail addressed to the present information processing apparatus (step 411).

While in the above operation, the CPU 10 causes the LCD 18 to display an operation state, thereby notifying the user of a transmission/reception state of an e-mail. FIG. 5C shows an example of display content indicating "NOW IN TRANSMISSION." In the e-mail transmission/reception state, display is made only to show a progress of the operation to the user, and the user is not permitted to perform any operation with reference to the display screen. Accordingly, only if a display of the operation state can be visually recognized on the LCD 18, some difficulty in viewing the display content will pose no problem.

If the e-mail transmission/reception is completed and the application program for e-mail transmission/reception is not finished (step 412), the CPU 10 causes the mail management display screen to be displayed once again and instructs the backlight drive circuit 24 to set the luminance of the backlight 26 at level 3 (60%) (step 407).

As has been described above, the CPU 10 that performs the main control discriminates the display content (application program to be executed) on the LCD 18 and causes the backlight drive circuit 24 to alter the luminance of the backlight 26 according to the display content. In other words, the luminance of the backlight 26 can be altered, depending on whether the kind of information to be displayed is a content which needs to be displayed with an increased luminance of the backlight 26, for instance, an image acquired by the camera 16 as shown in FIG. 5A, or a content which may be displayed with a lowered luminance of the backlight 26, for instance, text data as shown in FIG.

5B. Thus, the luminance of the backlight 26 can be reduced to a necessary lowest level according to display content, and power consumption can be saved. In addition, where display information intends only to show the operation state of the apparatus to the user and no operation is performed by the user through the display and input device, the luminance of the backlight 26 may be decreased to save power consumption.

The process for causing the backlight drive circuit 24 to alter the luminance of the backlight 26 may be incorporated into a higher-level program such as an operating system which manages a plurality of application programs, and, in this case, the higher-level program determines the display content at respective time points, thereby realizing the process of altering the luminance. Alternatively, the luminance altering process may be incorporated into each of the application programs 123 (steps 404–406 and steps 407–412 in FIG. 4), and the process may be executed according to display content in each process step.

The higher-level program controls the alteration of luminance of the backlight 26 when a specific application program is not run. Thereby, the luminance of the backlight 26 can be reduced to a minimum possible level, while avoiding occurrence of screen display that may deteriorate the operability. Thus, power saving is effected and the duration of battery-powered operations using the battery 36 can be increased. Where the luminance altering process is incorporated into the application programs 123, the luminance of the backlight 26 can be finely altered on the basis of a display content at each time point in the course of the execution of the application program.

In the above description, application programs are executed to perform the image acquisition by the camera and the mail transmission/reception, for instance. However, other application programs may be executed and the luminance of the backlight 26 can be adjusted in accordance with the content of the display screen in the course of execution of each application program.

In the above-described embodiment, the luminance of the backlight 26 is set at level 3 (60%) while the display content such as "e-mail text" is being input in step 408. After the display content has been input, the input content can be confirmed with no problem even if the luminance of the display is lower than that at the time of inputting the display content. Therefore, the luminance may be further lowered to level 4 (50%).

Figure 6:
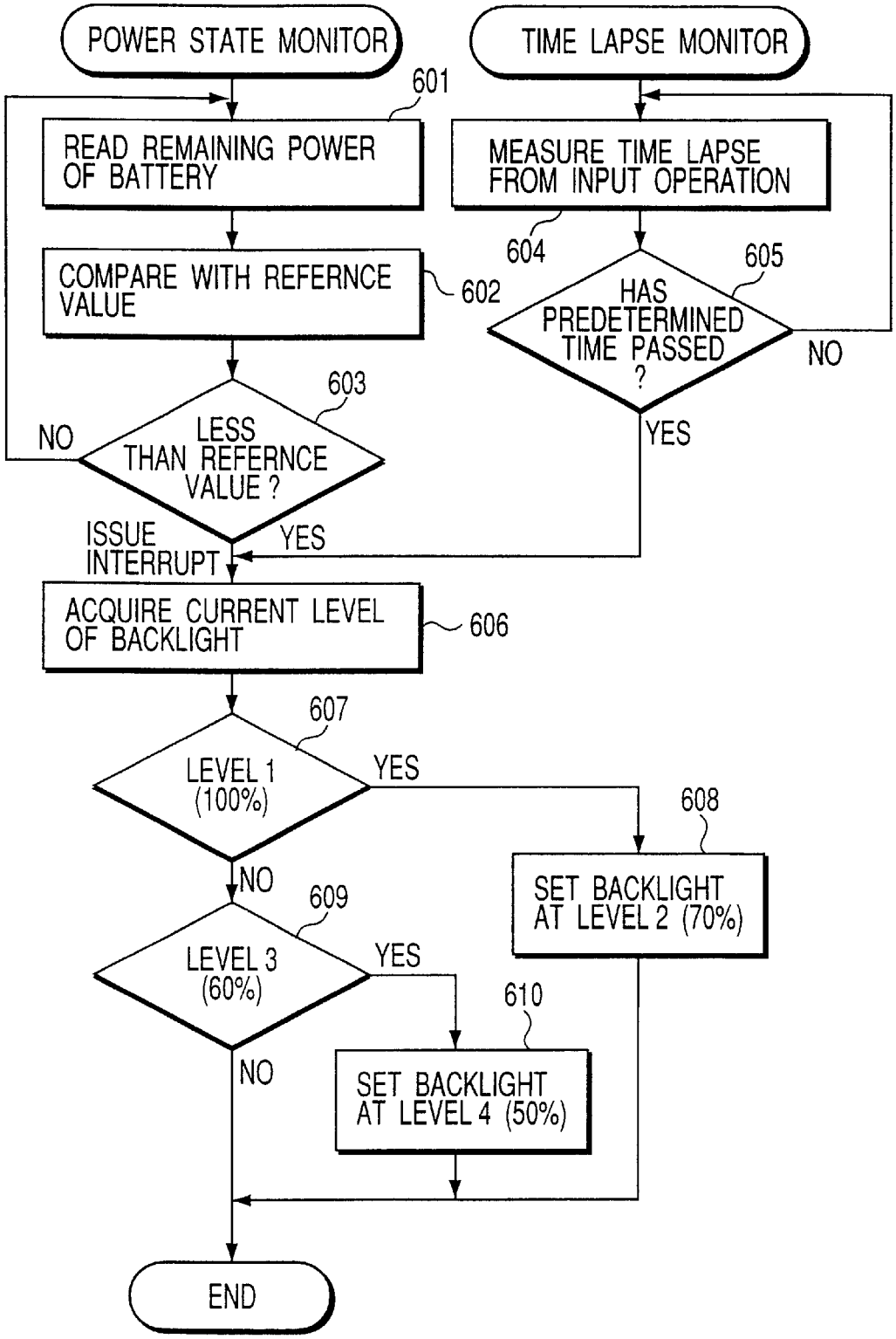
FIG. 6 is a flow chart illustrating an operation for varying the luminance of the backlight 26 in accordance with a state of a battery 36 and a lapse of time from latest input of data.

In addition to the above-described process of altering the luminance of the backlight 26 in accordance with the display content on the LCD 18, a description will now be given, with reference to a flow chart of FIG. 6, of a process of altering the luminance of the backlight 26 on the basis of the state of the battery 36 or a lapse of time from the latest input of data or a lapse of time from the latest operation of the operation section of the camera 16.

The power supply circuit 34 monitors the state (remaining power) of the battery 36. The CPU 10 reads, for example, periodically, data on the remaining power from the power supply circuit 34 (step 601). The CPU 10 compares the data on the remaining power of the battery 36 read from the power supply circuit 34 and a reference value for discriminating the remaining power of the battery 36 for ensuring predetermined normal operations (step 602). If the current remaining power of the battery 36 is greater than the reference value, it is determined that the normal operations can be carried out.

On the other hand, where the remaining power of the battery 36 is less than the reference value, the CPU 10 issues an interrupt instruction and executes the process of altering the luminance of the backlight 26. Specifically, where the remaining power of the battery 36 has become small, the luminance of the backlight 26 is decreased to save power consumption and increase the time for which the apparatus can operate.

After the interrupt instruction is issued, the CPU 10 acquires data on the current level of luminance of the backlight 26 (step 606). The data of the current luminance level of the backlight 26 is prestored in a predetermined area of the memory 12, for example, when an instruction to alter the luminance of the backlight 26 is to be issued to the backlight drive circuit 24.

If the luminance of the backlight 26 is at level 1 (100%), level 1 is changed to level 2 (70%) (step 608). If the luminance of the backlight 26 is at level 3 (60%), level 3 is changed to level 4 (50%) (step 610).

In short, the luminance of the backlight 26 is not uniformly changed to a predetermined level, but it may be changed on the basis of the luminance before being changed.

In parallel with monitoring the state of the battery 36, the CPU 10 monitors, with reference to the timer 101, a lapse of time from the latest input of data or a lapse of time from the latest operation of the switch (step 604). If the lapse of time measured by the timer 101 is greater than the predetermined value (step 605), the CPU 10 issues an interrupt instruction and executes the process of altering the luminance of the backlight 26 (step 606). The subsequent process is the same as the process executed where the remaining power of the battery 36 is less than the predetermined value. As has been described above, where no data has been input or the operation section has not been activated for a predetermined time period, it is probable that the user is not currently viewing the LCD 18 and in this case power is wasted if the luminance of the backlight 26 is maintained at high level. Accordingly, if a predetermined time has passed, the luminance of the backlight 26 is lowered and power consumption is decreased.

In the above description, where the luminance is at level 1, it is reduced to level 2 (70%). Where the luminance is at level 3, it is changed to level 4 (50%). However, the level of luminance, to which the current level of luminance is to be changed, may be freely chosen.

The level of luminance may be altered on the basis of not only the current level of luminance but also the display content according to the currently executed process. For example, when the menu is being displayed with the backlight 26 whose luminance is set at level 1, the luminance is lowered to level 5 (30%) if no problem arises in operation due to less clear display on the screen. On the other hand, where an image acquired by the camera 16 is displayed with the luminance at level 1, some problem may arise in confirming the display content if the luminance of the backlight 26 is lowered. In this case, therefore, the luminance may be lowered to level 2 (70%). In this way, the level of luminance may be altered on the basis of not only the current level of luminance but also the current display content.

The processes according to the above-described embodiment may be recorded, as computer-executable programs, on a recording medium such as a magnetic disk (floppy disk, hard disk, etc.), an optical disk (CD-ROM, DVD, etc.), or a semiconductor memory, and the recording medium may be provided to various apparatuses. In addition, the programs may be provided to various apparatuses by transmission through a communication medium. The computer realizing the functions of the present apparatus reads the programs recorded on the recording medium, or receives the programs via the communication medium. The operation of the program is controlled by the programs and thus the processes are executed.

As has been described above in detail, according to the present invention, the luminance of the backlight can be altered in accordance with a display content on the display screen. Where it is not necessary that the display content on the display screen be presented to the user in such a way that the display content may easily and clearly viewed by the user, the luminance of the backlight is controlled to decrease the power consumption without degrading the operability of the apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An information processing apparatus, comprising:

a display device for displaying information;

a backlight arrangement capable of providing various luminance levels of light to the display device;

discrimination means for discriminating a display content of information displayed on the display device;

screen control means for controlling a luminance of backlight provided to the display device in accordance with the display content discriminated by the discrimination means; and transmission/reception means for transmitting/receiving an e-mail, wherein the screen control means decreases the luminance of the backlight where the discrimination means has determined that a screen image indicative of a state in which the e-mail is being transmitted is to be displayed on the display device.

2. An information processing apparatus according to claim 1, wherein level of the decreased luminance is a minimum luminance level of pre-determined luminance levels for activating the backlight means.

3. An information processing apparatus according to claim 1, wherein the screen control means restores the luminance of the backlight to the luminance level prior to the transmission of the e-mail, where the discrimination means has determined that a screen image after the transmission of the e-mail is to be displayed on the display device.

4. An information processing apparatus, comprising:

a display device for display information;

a backlight arrangement capable of providing various luminance levels of light to the display device;

discrimination means for discriminating a display content of information displayed on the display device;

screen control means for controlling a luminance of backlight provided to the display device in accordance with the display content discriminated by the discrimination means; and transmission/reception means for transmitting/receiving an e-mail, wherein the screen control means alters the luminance of the backlight to a first luminance level where the discrimination means has determined that an input screen for inputting information relating to the e-mail is to be displayed on the display device, and the screen control means alters the luminance of the backlight to a second luminance level lower than the first luminance level where the discrimination means has determined that a screen for confirming information relating to the e-mail is to be displayed on the display device.

5. An information processing apparatus according to claim 4, wherein the screen control means alters the luminance of the backlight to a third luminance level lower than the second luminance level where the discrimination means has determined that a screen image indicative of a state in which the e-mail is being transmitted is to be displayed on the display device.

6. An information processing apparatus according to claim 5, wherein the screen control means alters the luminance of the backlight to the second luminance level where the discrimination means has determined that a screen image after the transmission of the e-mail is to be displayed on the display device.

7. An information processing apparatus, comprising:

a display device for displaying information;

a backlight arrangement capable of providing various luminance levels of light to the display device;

discrimination means for discriminating a display content of information displayed on the display device;

screen control means for controlling a luminance of backlight provided to the display device in accordance with the display content discriminated by the discrimination means; and second determination means for determining whether a predetermined time period has passes since a latest operation of camera operation means, wherein when the second determination means has determined that the predetermined time period has passed since the latest operation of the camera operation means, the screen control means decreases the luminance of the backlight.

* * * * *